US006082058A

United States Patent [19]

Deng

[11] Patent Number: 6,082,058

[45] Date of Patent: Jul. 4, 2000

[54] LIFTING METHOD OF BUILDING CONSTRUCTION FROM TOP TO BOTTOM

[76] Inventor: Genghou Deng, Lixiang Building, Room 304, Huaquio Town, Shenzhen 518053, China

[21] Appl. No.: 09/091,166

[22] PCT Filed: Aug. 27, 1997

[86] PCT No.: PCT/CN97/00086

§ 371 Date: Jun. 5, 1998

§ 102(e) Date: Jun. 5, 1998

[87] PCT Pub. No.: WO98/15696

PCT Pub. Date: Apr. 16, 1998

[30] Foreign Application Priority Data

Oct. 7, 1996 [CN] China ..... 96 1 19160

[51] Int. Cl.[7] ..... E02D 35/00

[52] U.S. Cl. ..... 52/125.1; 52/126.5; 52/749.1; 52/745.2; 52/745.05; 52/236.3

[58] Field of Search ..... 52/125.1, 126.5, 52/749.1, 745.2, 745.05, 236.3

[56] References Cited

U.S. PATENT DOCUMENTS

| | | | |
|---|---|---|---|
| 3,594,965 | 7/1971 | Saether | 52/126 |
| 3,722,169 | 3/1973 | Boehmig | 52/745 |
| 4,006,567 | 2/1977 | Flannery | 52/126 |
| 4,058,952 | 11/1977 | Donnelly | 52/741 |
| 4,250,671 | 2/1981 | Hirsh et al. | 52/167 |
| 4,251,974 | 2/1981 | Vanderklaauw | 52/745 |
| 5,205,673 | 4/1993 | Bolin et al. | 405/230 |
| 5,839,239 | 11/1998 | Jang | 52/123.1 |

*Primary Examiner*—Christopher T. Kent
*Assistant Examiner*—Jennifer I. Thissell
*Attorney, Agent, or Firm*—Merchant & Gould P.C.

[57] ABSTRACT

This invention relates to a lifting method of building construction from top to bottom, in which steel story posts are utilized for support columns needed by the building, all the stories are constructed on steel beams riveting positioned with steel story posts, all the steel story posts are lifted out story by story synchronously by underground jacking apparatuses. This lifting method can not only effectively overcome the defects such as long construction period, high cost, and difficulties in safety protection of the builders etc. in prior art, but also can be extensively applied in construction of special architectures such as high-rises or skyscrapers, large area indoor wall-bearing structures and various long-span bridges etc.

5 Claims, 3 Drawing Sheets

LIFTING METHOD OF BUILDING CONSTRUCTION FROM TOP TO BOTTOM

FIELD OF THE INVENTION

The invention relates to a construction method available for various architectures of large-scale high-rises, large-scale wall-bearing structures, single story and multi story viaducts spanning rivers and seas etc., more specifically to a lifting method of building construction from top to bottom.

BACKGROUND OF THE INVENTION

It is well-known, that existing construction method is a method adopting story-by-story construction from bottom to top, i.e. employing main machinery such as conventional tower cranes, truck cranes, hoists tubular steel scaffolds etc., starting from ground foundation, a building is constructed story by story from bottom to top, finally a top story is built, corresponding scaffolds are mounted around the building, when a top story is roofed, the main construction has been completed, then outer wall decorations being started and interior finishings ultimately conducted. Although problems of long construction period, high cost, difficulties in special building construction, and unsafe operation of the builders occurred, the above method is commonly used in China and all over the world. For a long time, aiming at above defects, massive work in tackling the key problems has been conducted by the engineering technical personnel in building industry, such as improving building materials and auxiliary tools, reforming construction methods and enhancing safety protection measures etc., but due to the inherent drawbacks in current construction method from bottom to top, the above problems have not been thoroughly solved.

Recently a brand-new construction method being conceived by the people, i.e. a countertrend construction method from top to bottom. For example, on Sep. 18, 1996, the "SHENZHEN SPECIAL ZONE DAILY" reported that, Japanese builders completed a medium height building by a hoisting method from top to bottom, in the method, a top story is constructed on the ground, the story is lifted with a plurality of tower cranes, then a penultimate story is built beneath the top story, the process was conducted story by story in sequence, until a whole building being completed. Partial defects of existing traditional method have been supplemented to a certain extent by the above method, e.g. construction schedule being accelerated, building cost reduced and safety betterment of the builders ensured, but since tower cranes are adopted for main auxiliary equipment in above new construction method, affected by the tonnage and height of tower crane and layout between a tower crane and building, accommodation of the method is greatly limited, which is only applicable in construction of ordinary buildings having finite height and area, and is absolutely unable to construct special architectures such as high-rises or skyscrapers, large area wall-bearing structures, and various longspan bridges etc., therefore the problems of prior art have not been completely solved.

DISCLOSURE OF THE INVENTION

An object of the invention is to provide a construction method of novel conception, a lifting method of building construction from top to bottom, no traditional building equipment such as existing tower cranes, hoists, tubular steel scaffolds etc. are needed, whereas using fully feasible jacking apparatuses and a method of constructing story by story from top to bottom can not only effectively overcome the defects of long construction period, high cost, difficulties in special building construction and lacking of builder safety protection in the prior art, but also have the advantages of wide accommodation, and is extensively applicable in special architectures such as high-rises or skyscrapers, large area wall-bearing structures and diversified longspan bridges etc.

The object of the invention is realized via a following program: a lifting method of building construction from top to bottom chiefly adopted a method of constructing story by story downwards from the top story of a building, wherein all the support columns needed by a building employ steel story posts, various floors are constructed on steel beams riveting positioned with the steel story posts respectively, all the above steel story posts are lifted out story by story synchronously by hydraulic jacking apparatuses mounted underground, a practical program thereof is:

a. Foundation piles of a building are driven preliminarily, at least a two story foundation structure is constructed underground, hydro-cylinders and hydraulic systems serving as the jacking apparatuses are installed at a lowest story underground, the upper story thereof is used for a work site supplying and installing columns of the building, the number of columns lifted out by the cylinders equals to the column number needed by the building;

b. On top of column supply and installation work site, a roof and penthouse of top story of the building is constructed;

c. After all the columns are lifted synchronously via the jacking apparatuses thereunder to a story height in building design, positioned with positioning plug-in steel tenons, various columns are connected by steel beams to form a top story frame of the building, then the floor and outer walls of top story in the building are constructed;

d. The cylinder pistons are withdrawn at the column supply and installation work site, new columns are mounted, after a top story is built, all the columns are lifted synchronously via the jacking apparatuses thereunder to a story height of the building design, being positioned with the positioning plug-in steel tenons, various columns are connected by steel beams to form a frame of penultimate story of the building, then the floor and outer walls of penultimate story of the building are constructed;

e. Repeat above working procedures, until a ground story of the building is constructed, then the pistons of jacking apparatuses are withdrawn, continue to complete the underground stories of the building.

A round or polygonal steel hallow column is used for the steel story post, both ends thereof are machined. The posts can be interconnected in tight fit, several positioning holes matchable with the positioning plug-in steel tenons are set on a periphery of steel story post.

Adopting a lifting method of building construction from top to bottom, in comparison with existing construction methods, it has the following distinct advantages:

1. Adapting a lifting construction method, all the building elements can be entirely produced in a factory flow-line, assembling and finishing can be conducted on site, consequently labour is greatly saved and building efficiency raised, construction periods of a high-rise and a large bridge can be shortened by a half and two thirds of time respectively.
2. In a whole working process of lifting construction method, outdoor works are all done in the height of one story beyond the ground, other work being entirely conducted indoor. Accordingly, all-weather working can be preformed, production design being enhanced, and construction period can be strictly executed and shortened;

3. Adopting a lifting construction method, no high altitude operation exists even in constructing a one-hundred-story mansion, the foundation frame and any lifted story are completed on the height of ground floor, since the foundation frame and any lifted story frames are steel structures, it is quite safe in frame stabilization and construction, therefore in contrast with conventional construction methods, human injuries can be greatly alleviated.
4. Superhuge indoor wall-bearing structures such as indoor standard athletic fields, football fields etc. being hard to build with conventional construction methods, can be easily constructed by the lifting method. On constructing the type of a large building, the roof is formed by assembly unit construction on the ground and then lifted to a designed height, which is not only convenient and fast, but also time, money and labour saving, and is a striking contrast to other construction methods.
5. Main equipment of lifting method being entirely operated underground and at ground floor, accordingly low noise, little influence and pollution to environment are resulted, furthermore, since the main part of a project and outer decorations are conducted synchronously, all the elevated portions are completed, therefore positive contributions are made to city-scape and beautification of the environment.
6. No rigid connection has been adopted between each support column and foundation pile of completed building according to the lifting method, whereas foundation piles and support columns are separated by an antishock layer and fastened by ground bolts (after a building is completed, the ground bolts can even be loosened), therefore when an earthquake takes place, most of crustal impact forces shall be disintegrated before reaching the antishock layer. The building itself is a steel structure frame, having an extremely strong shock resistance.

Consequently, the lifting method of the invention can not only overcome the defects of long construction period, high cost, difficulties in special structure construction and lacking of builder safety protection, but also has the advantage of wide accommodation, can be extensively used in construction of special architectures such as high-rises of skyscrapers, large area indoor wall-bearing structures, various over water buildings and longspan bridges etc.

Figure 1:
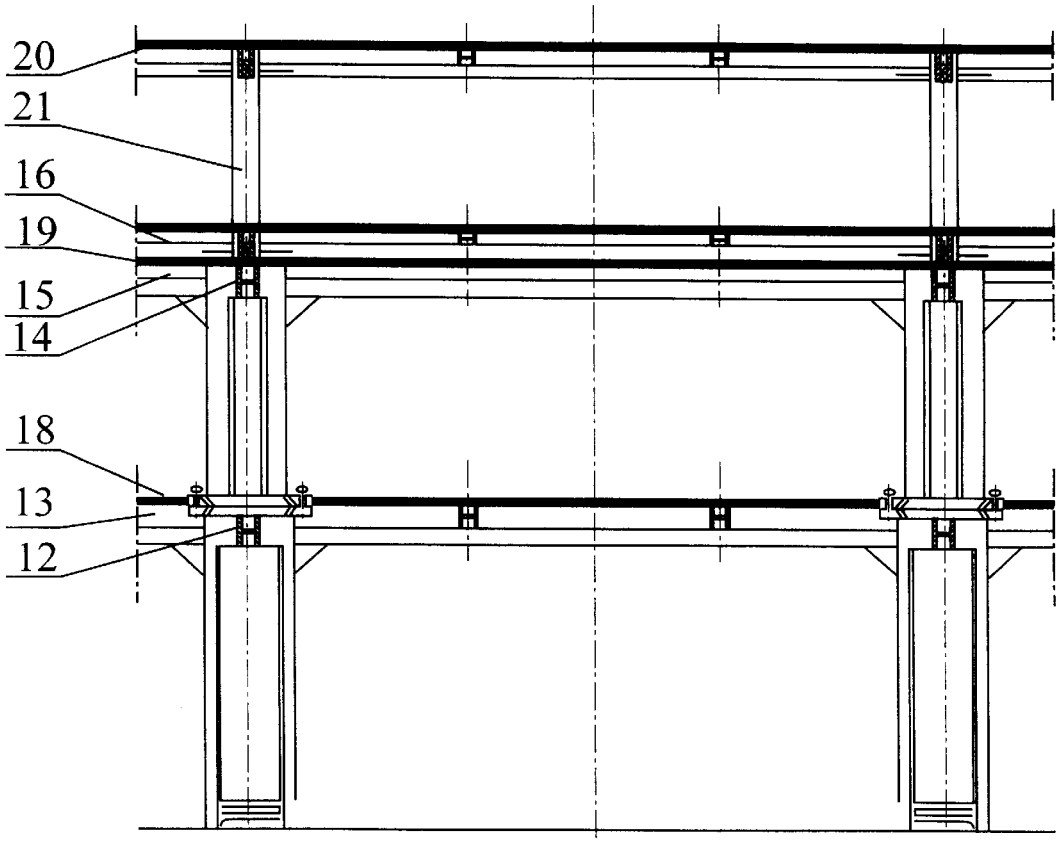
FIG. 1 is a structural schematic diagram of a building in the invention.
Figure 2:
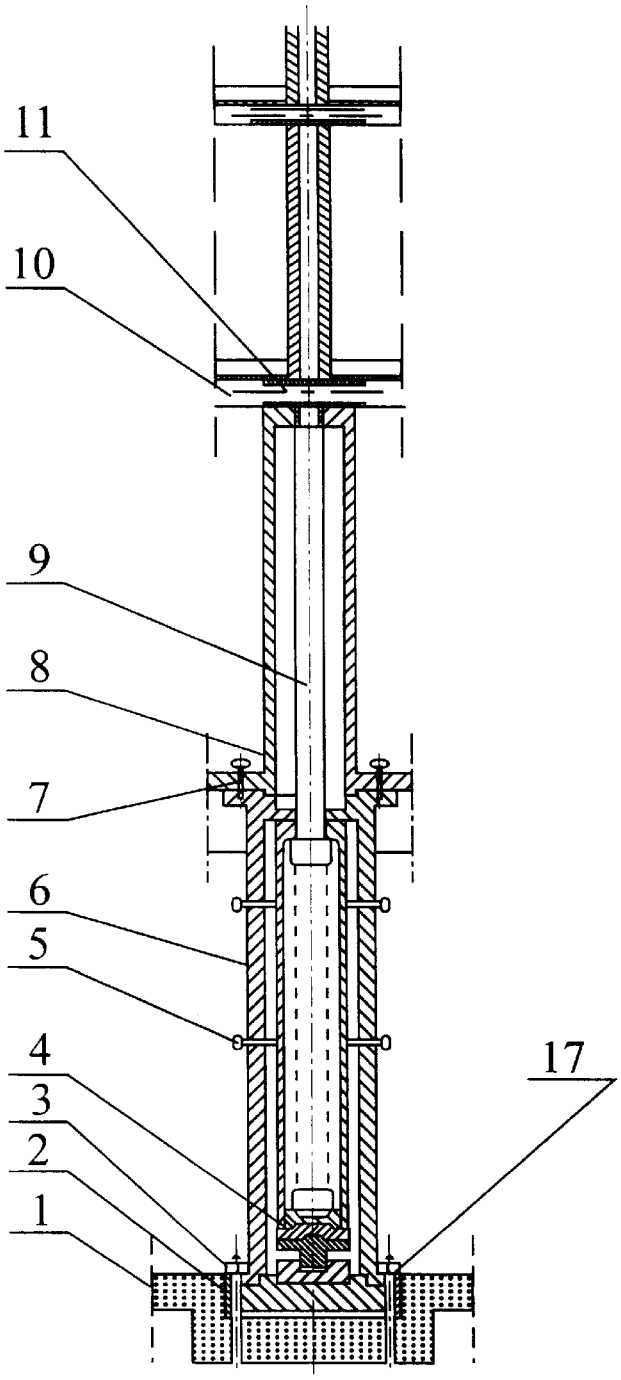
FIG. 2 is a schematic diagram of a jacking apparatus in the invention.
Figure 3:
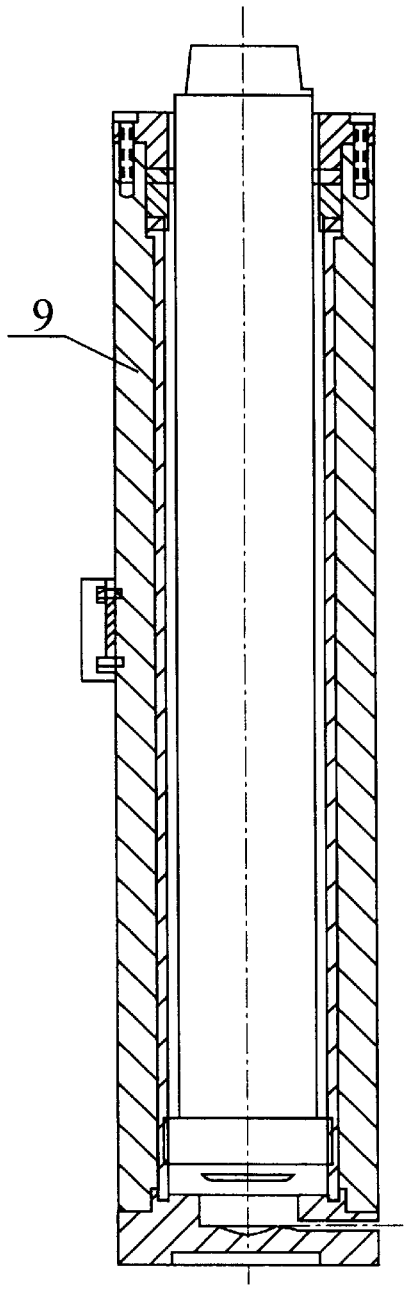
FIG. 3 is structural schematic diagram of a main lift cylinder in the invention.
Figure 4:
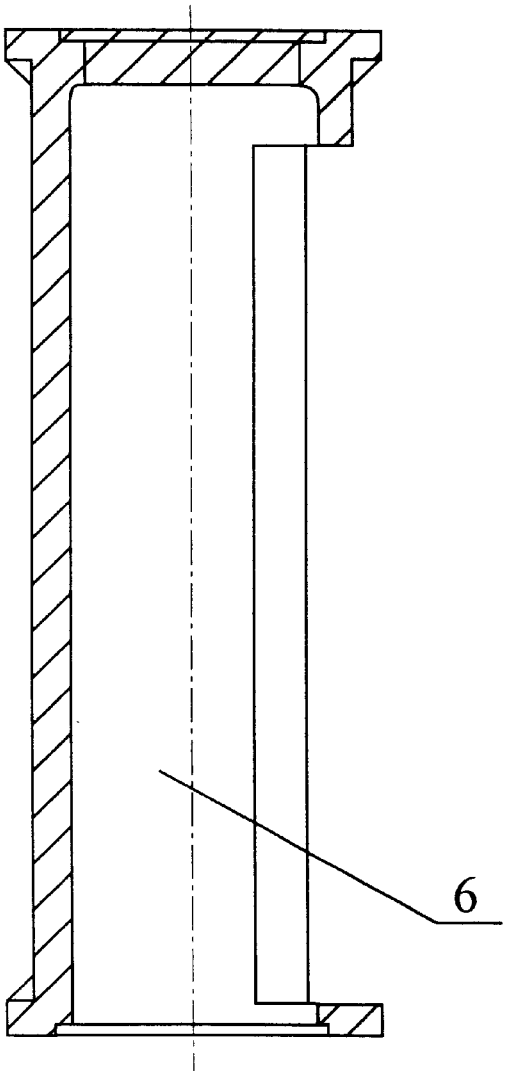
FIG. 4 is a structural schematic diagram of a cast steel hollow column in the invention.
Figure 5:
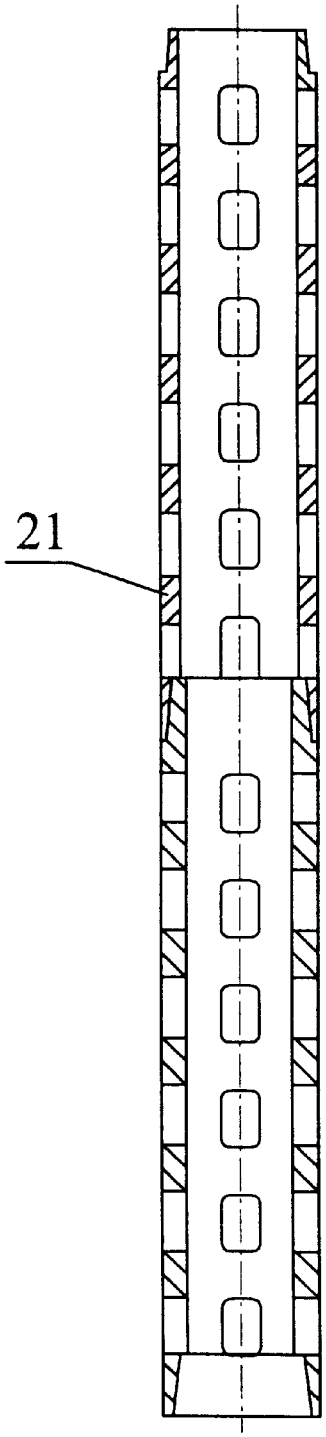
FIG. 5 is a structural schematic diagram of a steel story post in the invention.

In which: 1 is a column foundation pile, 2 is an antishock layer, 3 is a horizontal foundation positioning steel disk, 4 is an adjustable cylinder base, 5 is a cylinder positioning screw, 6 is a cast steel hollow column (of the first story), 7 is a joint bolt, 8 is a cast steel hollow column (of the second story), 9 is a main lift cylinder, 10 is a main story steel beam, 11 is a positioning plug-in steel tenon, 12 is a main steel beam of the first story(underground), 13 is an auxiliary steel beam of the first story(underground), 14 is a main steel beam of the second story (underground), 15 is an auxiliary steel beam of the second story (underground), 16 is an auxiliary story steel beam, 17 is a ground bolt, 18 is a floor of the first story (underground), 19 is a floor of the second story (underground), 20 is a penthouse, 21 is a steel story post.

DETAILED DESCRIPTION OF THE PREFERRED EMBODIMENT

The invention shall be described in detail incorporating with the drawings and embodiments.

An embodiment of the invention applied in a high-rise construction is shown in the drawings.

A lifting method of building construction from top to bottom, chiefly adopted a construction method conducted downwards story by story from the top of the building. Steel story posts are mainly utilized for all support columns needed by the building, various story floors are built on the steel beams riveting positioned with the steel story posts, all the above steel story posts are lifted out by underground jacking apparatuses synchronously story by story, the working procedures are:

a. Foundation piles are driven preliminarily, at least a tow story foundation structure should be constructed underground, cylinders and hydraulic systems used for the jacking apparatuses being installed at the lowest story under the ground, an upper story thereof serve as a work site installing and supplying columns of the building, the number of columns lifted out by the cylinders equals to the column number needed by the building;
b. The roof of top story and the penthouse thereof is constructed on the work site installing and supplying the columns;
c. After all the above columns are lifted to the designed story height of the building via the jacking apparatuses thereunder synchronously, positioned with positioning plug-in tenors, various columns are connected by steel beams to form a top story frame of the building, then the floor and outer walls of top story are constructed;
d. Cylinder pistons are withdrawn on a story of work site installing and supplying the columns, new columns are mounted, after a top story is constructed, all the columns are lifted to the designed story height of the building via the jacking apparatuses thereunder, positioned by the positioning plug-in steel tenors, various columns are connected by steel beams to form a story frame of penultimate story in the building, then the floor and outer walls of penultimate story in the building are constructed;
e. Repeat above procedures, until a ground story of the building is constructed, then the jacking apparatuses are withdrawn, and the underground stories are completed in succession.

The above jacking apparatus consists of a cast steel hollow column 6 (of the first story), a cast steel hollow column 8 (of the second story), a main lifting cylinder 9 mounted in the cast steel hollow column 6 (of the first story), a horizontal foundation positioning steel disk 3, an adjustable cylinder base 4 and corresponding hydraulic oil supply equipment, a round or polygonal hollow steel column is adopted for a steel story post 21, both ends thereof are machined capable of interconnecting in tight fit, and several positioning holes matchable with positioning plug-in steel tenons 11 are opened on the periphery of the steel story post 21.

A lifting construction method of the invention shall be further described as follows:

1. Column foundation piles 1 of the building are driven according to a conventional method preliminarily, upper plane of the column foundation piles 1 preferably to be in the same level of the bottom plane of the second story underground;
2. A layer 2 of antishock material, like fine and uniform conundrum granules etc., being laid on the upper plane of column foundation piles 1;
3. The machined horizontal foundation positioning steel disks 3 are placed on an antishock layer, all the horizontal positioning steel disks 3 needed by the building are adjusted to a same level and the coordinates according to designed requirements;
4. The adjustable cylinder base 4 is placed on a horizontal foundation positioning steel disk, an outer circle on the bottom of base is concentrically matched with a concave circle on the upper portion of a positioning steel disk via machining, then the planes on all the bases are adjusted to a same level;
5. The cast steel hollow column 6 of the first story is placed on the horizontal foundation positioning steel disk 3, meanwhile a horizontal foundation positioning disk, an adjustable cylinder base and a cast steel hollow column are concentric, an access capable of inserting the main lift cylinder 9 is opened on side of the above cast steel hollow column 6;
6. After all the cast steel hollow columns 6 of the first story are vertically adjusted, a horizontal foundation positioning disk, the cast steel hollow column 6, an adjustable cylinder base are all rigidly positioned with a foundation column pile altogether by ground bolts 17;
7. All the cast steel hollow columns 6 of the first story, first story main steel beams 12 and first story auxiliary steel beams 13 are bolted or riveted or welded to be a rigid perpendicular, square and upright steel structure frame;
8. Steel plates or reinforced concrete are laid on the above steel beams to construct a floor of the first story 18 on the foundation frame;
9. The main lift cylinder 9 is hoisted into an inner hole of the cast steel hollow column 6 of the first story, the bottom of main lift cylinder 9 is positioned on the adjustable cylinder base 4; the upper end thereof is positioned in an upper inner circle of the cast steel hollow column 6, all the three above components are concentrically matched;
10. The main lift cylinder 9 is rigidly fixed in the cast steel hollow column 6 of the first story with cylinder positioning screws 5;
11. The cast steel hollow column 8 of the second story is mounted on the above cast steel hollow column 6 of the first story, and firmly locked with joint bolts 7 in connection, inner space of the column can match with the piston head of main lift cylinder, an access capable of inserting the steel story post 21 is opened on side thereof;
12. Second story main steel beams 14, second story auxiliary steel beams 15 and the various cast steel hollow columns 8 of the second story are bolted or riveted or welded there between to be secured into a perpendicular, square and upright rigid steel structure foundation frame, capable of bearing the pressure of a whole building;
13. A floor of the second story 19 on the foundation frame is constructed by laying steel plates or reinforced concrete on above steel frame, to form a first story floor of the building on a same level with outer ground;
14. The steel story post 21 is inserted onto a piston head of the main lift cylinder 9 in the inner space of the cast steel hollow column 8 (of the second story) via erection tools (like a forklift), after adjustment, all the cylinders controlled by a computer lift up synchronously, when an upper end of the steel story post 21 is lifted out from the cast steel hollow column 8, a support column of the building is formed, several fourway square filleted holes matchable with the positioning plug-in steel tenons 11 are set up on a tube wall of the above steel story post 21;
15. Upper portions of the columns are connected into a horizontal, right angled steel frame using I-steel beams, lay steel plates or reinforced concrete and waterproof thermal protective coating etc. on the steel frame, a penthouse 20 of the building is formed, installations such as water tank, lightning arrester, solar energy facilities, advertising signboards etc. can be preset on the roof;
16. After all the roof installations have been mounted, all the steel story posts 21 are lifted via hydro-cylinders successively, until all the prefabricated fourway square filleted holes on the steel story posts 21 emerged out of the second story floor of foundation frame, the positioning plug-in steel tenons 11 are inserted into the steel story posts 21, a top story of the building is firmly supported on the foundation frame, and the pistons of cylinders are withdrawn. Since the inner and outer circles of upper and lower ends on the steel story post 21, inner circle of upper end on the cast steel hollow column 8 of the second story and the piston of main lift cylinder 9 are matched via machine work according to a same requirement, therefore all the supported stories can strictly ensure the horizontality, verticality required in design. After the top story is completed, top story facilities such as elevator machine room etc. can be installed.
17. After the positioning plug-in steel tenons 11 and the steel story posts 21 are rigidly welded, story main steel beams 10 and story auxiliary steel beams 16 are rigidly connected on the above mentioned steel story posts 21 via bolting or riveting or welding, thereby a top story of the building is completed.
18. Steel plates or reinforced concrete being laid on a floor steel frame of top story, meanwhile outer walls of the building are constructed and outer wall finishings are conducted, above outer walls can be prefabricated into large area hollow walls, and inserted into the grooves of a I-steel beam main frame;
19. After outer walls of the top story are completed, steel story posts of the second story are placed on the pistons in the cast steel hollow columns of the second story to be lifted, when the hammer shaped circular columns on top of steel story posts of the second story are inserted into inner hammer shaped round holes on bottom of steel story posts of the first story, tight fit enables the floor of top story to be stably lifted, when a joggle of two columns are lifted out of ground, the joggle is rigidly welded with electric welding. The hydro-cylinders continue to be lifted, after prefabricated four-way square filleted holes on steel story posts emerged out of the floor of the second story 19, the positioning plug-in steel tenons 11 are inserted into the steel story posts 21, top story of the whole building is firmly supported on the foundation frame, withdraw the cylinder pistons, after the positioning plug-in steel tenones are rigidly welded with the steel story posts, story main steel beams and story auxiliary steel beams are secured on above steel story posts via bolting or riveting or welding, steel plates or reinforced concrete being laid on the story steel frame, meanwhile outer walls of the building is constructed and carry out outer wall decorations, at the same time indoor partitions and inner finishings of the upper story can be conducted. Repeat the process again and again, constructing from top to bottom, each story is lifted after completion successively, until the ground story is built, then the main part of the building is wholly completed;

20. After a last story (the first story on the ground) is completed, the adjustable cylinder base 4 being regulated to the bottom and is departed from the main lift cylinder (the main lift cylinder is unmoved under fixation with cylinder positioning screws), the adjustable cylinder base is withdrawn by a forklift, and then the main lift cylinder is taken out. The cavities of all the cast steel hollow columns 6 of the first story are firmly placed with reinforced concrete (if the strength of the cast steel hollow column of the first story is sufficient, then preserve the original state), finally all the jacking apparatuses are hauled away, and the underground foundation structure is built as a parking lot or other special facilities.

INDUSTRIAL APPLICABILITY

Adopting a lifting construction method of the invention, it is extensively available for special architectures like various steel structures and composite buildings of steel and reinforce, highrises or skyscrapers, large area wall-bearing structures and diversified longspan bridges etc.

I claim:

1. A lifting method for constructing a building from top story to bottom story comprising the following steps:

a. Column foundation piles (1) of a building are driven preliminarily according to traditional methods at a second story underground;

b. Antishock material being laid on an upper plane of the column foundation piles (1) to form an antishock layer (2), ground bolts (17) are mounted, machined horizontal positioning steel disks (3) are laid on the antishock layer (2), all the horizontal foundation positioning disks (3) needed by the building are installed according to coordinates of various support columns, and are adjusted to the same height;

c. An adjustable cylinder base (4) is laid on the horizontal positioning disk (3), then all the planes on the base being adjusted to a same horizontal height; then a cast steel hollow column (6) is laid on the horizontal foundation positioning disk (3), the cast steel hollow column (6) being adjusted, the horizontal positioning disk (3) and the cast steel hollow column (6) are fastened with the ground bolts (17);

d. All of the cast steel hollow columns (6) are connected by main steel beams of a first story (12) via bolting or welding, then a story frame is formed with auxiliary steel beams of the first story (13) and the main steel beams of the first story (12) utilizing bolting or welding, steel plates are laid on the frame, concrete being placed and a floor of the first story (18) is produced;

e. A main lift cylinder (9) is laid down in a round hole on top of the cast steel hollow column (6), a lower end face of the main lift-cylinder (9) is positioned on an upper end face of the adjustable cylinder base (4), then an outer periphery on the upper end is inserted in an inner circle of upper end of the cast steel hollow column (6), all three above components are machined in concentric fit reaching a definite matching accuracy;

f. The main lift cylinder (9) is rigidly positioned on the cast steel hollow cylinder (6) with a cylinder positioning screw (5);

g. A lower end face of a cast steel hollow column (8) is sheathed on an upper end face of the cast steel hollow column (6), being adjusted, connected and firmly locked with a joint bolt (7), then a steel structure foundation frame is formed using auxiliary steel beams (15) and the cast steel hollow columns (8) connected by bolting or welding, then steel plates are laid on a steel frame, placing concrete to form a floor of the second story (19), which is in the same ground level;

h. A steel story post (21) is inserted into the cast steel hollow column (8) via erecting tools, causes the lower end of the steel story post (21) to be sheathed on a conical piston head of the main lift cylinder (9) via a machined conical bore the pistons of all the cylinders are lifted synchronously via a hydraulic jacking apparatus, when the pistons rise, the steel story posts (21) are lifted out from upper end internal holes of the cast steel hollow cylinders (8), top ends of lifted out steel posts are connected to form a horizontal square and upright steel frame by bolting or welding to prepared steel beams, while steel plates, reinforced concrete and waterproof thermal protective coatings are laid on the steel frame, and a penthouse (20) is formed;

i. After a roof of the top story is completed, the cylinders continue lifting, until all the fourway square filleted througholes on the lower sides of steel story posts (21) are lifted out of a roof of the floor of the second story (19) on a foundation frame, positioning plug-in steel tenons (11) are passed through the side through holes of the steel story posts (21), the top story of the building is supported on the foundation frame, and the positioning plug-in steel tenons (11) are rigidly welded with the steel story posts (21);

j. Main story steel beams (10) and auxiliary story steel beams (16) are in fixed linkage at the positioning plug-in steel tenons (11) and the steel story posts (21) via bolting or riveting or welding, lay steel plates on steel beams, placing concrete, outer walls, partitions and other construction facilities, after the interior and exterior finishings being completed, then a top story of the building is constructed;

k. On carrying out the above working procedures, pistons of the main lift cylinders (9) retrieved, the steel story posts (21) are remounted, after an upper story is constructed, pistons are lifted, taper cones newly mounted on top of the steel story posts (21) of an upper story, since both interconnected ends of the steel story posts (21) are machine cut, having a definite matching accuracy, therefore an upper story can be lifted stably in a vertical direction, when fourway square filleted openings on lower sides of the steel story posts (21) emerge from the floor of the second story (19) on the foundation frame, the positioning plug-in steel tenons (11) are inserted to the fourway square filleted openings on lower sides of the steel story posts (21), the constructed top story and penultimate top story are supported on the foundation frame, repeat the said procedures of i. and j., after the penultimate top story is completed, thus construct from top to bottom story by story, until the first story on the ground has been constructed, which is the first story beyond the steel structure foundation frame;

l. After all the stories are completed, the adjustable cylinder base (4) is turned to the bottom level, withdraw, then the main lift cylinder is dropped and taken out from a side opening of the cast steel hollow column with a forklift, the reinforced concreted being placed in the hollow openings of the cast steel hollow columns (6), (8) and steel story posts (21), finally interior and exterior finishings of the first story on the ground and the second story of foundation frame are completed.

2. A lifting method for constructing a building from top story to bottom story in accordance with claim 1, wherein the said hydraulic jacking apparatus comprises of the cast steel hollow columns (6), (8), the main lift cylinder (9), the horizontal foundation positioning disk (3), the adjustable cylinder base (4) and corresponding hydraulic oil supply device thereof, further comprising the step of installing the main lift cylinder (9) into the cast steel hollow column (6).

3. A lifting method for constructing a building from top story to bottom story in accordance with claim 1, further comprising the step of shaping said steel story posts (21) to adopt round or polygonal shaped hollow steel posts, machining both ends thereof to be closely matched in connection, and opening several positioning holes matching with the positioning plug-in steel tenons (11) on the periphery of the steel story post (21).

4. A lifting method for constructing a building from top story to bottom story in accordance with claim 1, wherein an opening insertable of the main lift cylinder (9) is opened on the said side of the cast steel hollow column (6) for installing the main lift cylinder (9).

5. A lifting method for constructing a building from top story to bottom story in accordance with claim 1, wherein the said cast steel hollow column (8) for mounting the steel story post (21), its inner space is matchable with a piston head of the main lift cylinder, and an opening is opened on a side thereof which can insert the steel story post (21).

* * * * *